US008492916B2

(12) United States Patent
Murata et al.

(10) Patent No.: US 8,492,916 B2
(45) Date of Patent: Jul. 23, 2013

(54) SWITCHING APPARATUS FOR STARTER

(75) Inventors: Mitsuhiro Murata, Niwa-gun (JP); Takahisa Inagaki, Nishio (JP)

(73) Assignee: Denso Corporation, Kariya (JP)

( * ) Notice: Subject to any disclaimer, the term of this patent is extended or adjusted under 35 U.S.C. 154(b) by 406 days.

(21) Appl. No.: 13/021,227

(22) Filed: Feb. 4, 2011

(65) Prior Publication Data

US 2011/0187127 A1 Aug. 4, 2011

(30) Foreign Application Priority Data

Feb. 4, 2010 (JP) ..... 2010-023104

(51) Int. Cl.

| | |
|---|---|
| ***F02N 11/00*** | (2006.01) |
| ***H02P 9/04*** | (2006.01) |
| *H01H 67/00* | (2006.01) |
| *H01H 67/02* | (2006.01) |

(52) U.S. Cl.
USPC ..... 290/38 R; 335/106; 335/126

(58) Field of Classification Search
USPC ..... 290/38 R; 335/106, 126
See application file for complete search history.

(56) References Cited

U.S. PATENT DOCUMENTS

| | | | | |
|---|---|---|---|---|
| 4,494,162 | A * | 1/1985 | Eyler | 361/29 |
| 5,239,954 | A * | 8/1993 | Boegner et al. | 123/179.3 |
| 5,731,638 | A | 3/1998 | Niimi | 290/38 R |
| 7,659,801 | B2 * | 2/2010 | Kusumoto et al. | 335/126 |
| 8,258,639 | B2 * | 9/2012 | Labbe et al. | 290/38 A |
| 2004/0207204 | A1 * | 10/2004 | Shiga et al. | 290/38 R |
| 2009/0206965 | A1 | 8/2009 | Niimi | 335/106 |
| 2010/0271155 | A1 * | 10/2010 | Kaneda et al. | 335/126 |
| 2012/0200093 | A1 * | 8/2012 | Venkatasubramaniam et al. | 290/38 R |

FOREIGN PATENT DOCUMENTS

| | | |
|---|---|---|
| EP | 0 751 545 A1 | 1/1997 |
| JP | A-07-109967 | 4/1995 |
| JP | A-07-174062 | 7/1995 |
| JP | A-2009-191843 | 8/2009 |
| JP | A-2009-224315 | 10/2009 |
| WO | WO 01/51807 A1 | 7/2001 |

OTHER PUBLICATIONS

Mar. 8, 2012 Extended Search Report issued in European Patent Application No. 11000869.5.
Partial European Search Report issued in European Patent Application No. 11000869.5 dated Jun. 27, 2011.

* cited by examiner

*Primary Examiner* — Pedro J Cuevas
(74) *Attorney, Agent, or Firm* — Oliff & Berridge, PLC

(57) ABSTRACT

There is disclosed a switching apparatus for a starter comprising a resistor for suppressing a startup current of a motor when an engine is started, an electromagnetic relay for bypassing the resistor to energize the motor after the motor is started, a function for pushing a pinion of the starter toward a ring gear, an electromagnetic switch for opening and closing a main contact of the motor circuit. The resistor, the electromagnetic relay, and the electromagnetic switch are integrally accommodated inside a housing formed of a metallic bottomed frame and a contact cover, and are connected to the motor circuit via two external connection terminals fixed to the contact cover. The apparatus can facilitate connectivity to the vehicle side by reducing the number of cables and can enhance an installation property.

20 Claims, 9 Drawing Sheets

SWITCHING APPARATUS FOR STARTER

CROSS-REFERENCE TO RELATED APPLICATION

This application is based on and claims the benefit of priority from earlier Japanese Patent Application No. 2010-23104 filed Feb. 4, 2010, the description of which is incorporated herein by reference.

BACKGROUND

1. Technical field of the Invention

This invention relates to a switching apparatus for a starter that incorporates a resistor for suppressing a startup current of a motor when an engine is started, and a function for bypassing the resistor to energize the motor after the engine is started.

2. Related Art

Conventionally, a starter for starting an engine includes a function for pushing a pinion toward a ring gear of the engine, and an electromagnetic switch for opening and closing a main contact in a motor circuit (i.e., a circuit for applying an electrical current from a battery to a motor).

When the motor is started, i.e., when the electromagnetic switch closes the main contact, a higher current called an inrush current flows into the motor from the battery. Thus, there may occur phenomena called "instantaneous interruption" in which a terminal voltage of the battery significantly drops, which leads to instantaneous break down of electrical equipment such as an indicator and an audio system.

Commonly assigned Japanese Patent Application Publication No. 2009-224315 discloses a technique for suppressing such an inrush current that may occur when the motor is started.

According to the invention of the above patent application, besides the electromagnetic switch, there is provided an electromagnetic relay for opening and dosing the motor circuit. The electromagnetic relay incorporates a resistor to be connected to the motor circuit, and a relay contact arranged in parallel with the resistor. Opening and closing the relay contact enables one energizing path to the motor through the resistor and another energizing path to the motor that bypasses the resistor to be switched therebetween.

With this configuration, when the motor is started, the electromagnetic relay is in an off-state, i.e., the relay contact is open. A startup current is then suppressed, the motor rotates at a lower rotation speed (when the relay contact is open). After that, the electromagnetic relay is turned on, i.e., the relay contact is closed. Since both ends of the resistor are then short-circuited, the full voltage of the battery is applied to the motor. Accordingly, the motor rotates at a higher rotation speed.

According to the invention of the above patent application, however, since the electromagnetic switch and the electromagnetic relay are individual components, it is required to reserve an installation space for the electromagnetic relay, besides an installation space for the electromagnetic switch. Further, the increasing number of wirings to the electromagnetic switch may generate a problem with installation onto a vehicle. For example, since the electromagnetic relay is inserted between the battery and the electromagnetic switch, the number of cables for supplying electrical power from the battery to the motor may be increased. In other words, since a first cable for connecting the battery and the electromagnetic relay, and a second cable for connecting the electromagnetic relay and the electromagnetic switch are required, the number of processes increases as the increasing number of cables increases, which leads to a higher manufacturing cost.

In consideration of the foregoing, exemplary embodiments of the present invention are directed to providing a switching apparatus for the starter that implements in a single housing a function for pushing a pinion of the starter toward a ring gear, a function for opening and dosing the main contact, a resistor for suppressing a startup current when the engine is started, a function for bypassing the resistor to energize the motor after the motor is started, thereby improving connectivity to the vehicle side and an installation property onto the vehicle.

SUMMARY

In accordance with an exemplary aspect of the present invention, there is provided a switching apparatus for a starter, the apparatus comprising: pinion-pushing means for pushing a pinion of the starter toward a ring gear of an engine; main-contact-switching means for opening and closing a main contact for a motor circuit for supplying electrical power from a battery to a motor; a resistor for suppressing a startup current that flows from the battery to the motor when the motor is started, the resistor being connected to the motor circuit; and energizing-path-switching means for switching between a higher-resistance energizing path from the battery to the motor through the resistor and a lower-resistance energizing path that bypasses the resistor to energize the motor, wherein the pinion-pushing means, the main-contact-switching means, the resistor, and the energizing-path-switching means share a single housing, and are integrally accommodated inside the housing.

The energizing-path switching means is capable of switching between a higher-resistance energizing path to energize the motor via the resistor and a lower-resistance energizing path that bypasses the resistor to energize the motor. When the motor is started, the motor is energized via the higher-resistance energizing path, and then an electric current suppressed by the resistor is applied to the motor. In other words, an inrush current is suppressed for the motor to rotate at a lower rotation speed. Once the energizing path is switched from the higher-resistance energizing path to the lower-resistance energizing path, the full voltage of the battery is applied to the motor. The motor then rotates at a higher rotation speed than when the motor is started. Accordingly, the rotation speed of the motor is increased.

In the switching apparatus for the starter, the energizing-path switching means and the resistor are integrally accommodated inside the housing together with the pinion-pushing means and the main-contact switching means. This enables the whole apparatus to be made compact, and its installation property onto a vehicle is significantly improved.

DESCRIPTION OF SPECIFIC EBODIMENTS

The present inventions will be described more fully hereinafter with reference to the accompanying drawings. Like numbers refer to like elements throughout.

(First Embodiment)

Figure 1:
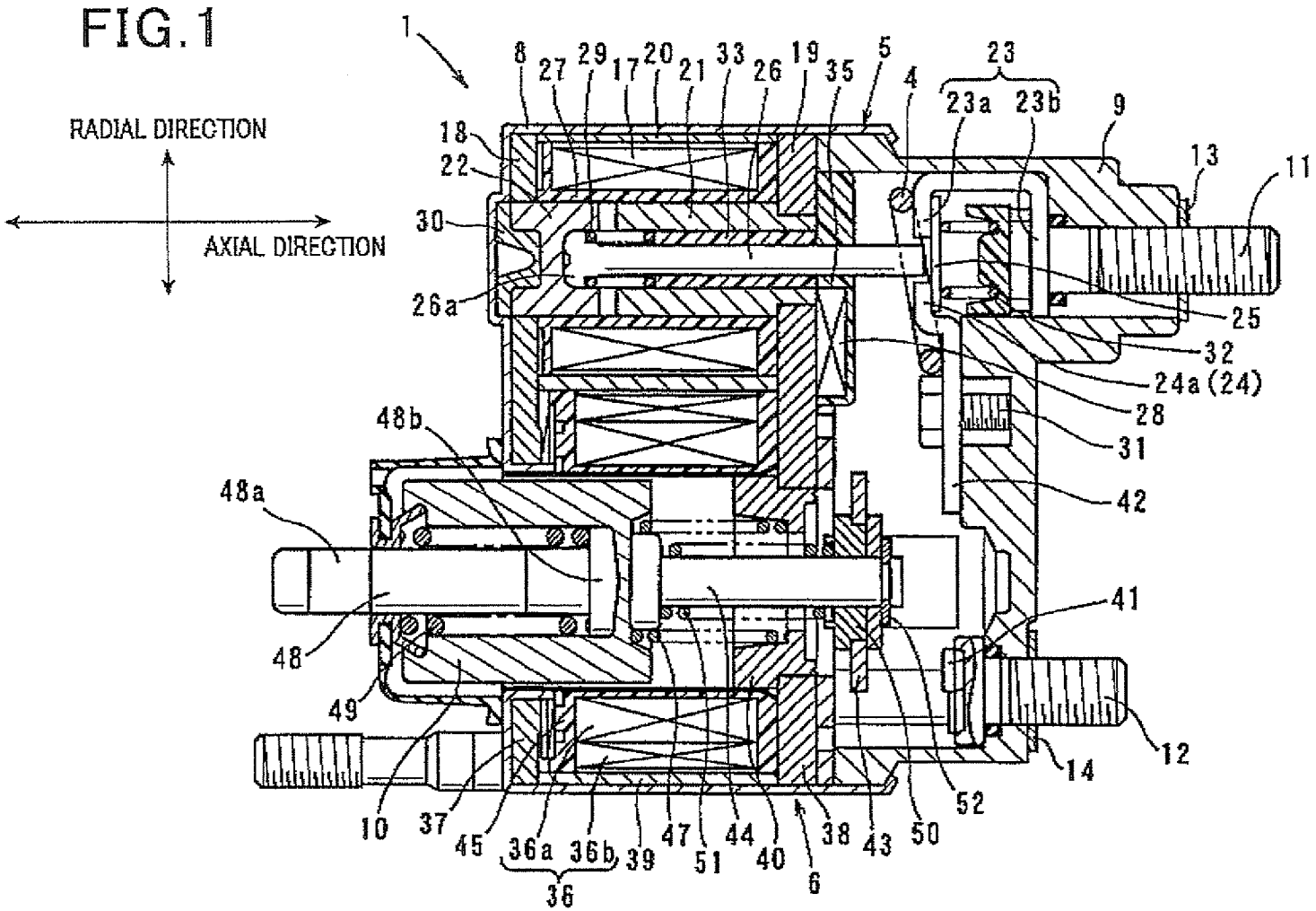
FIG. 1 is a cross sectional view of a switching apparatus for a starter in accordance with a first embodiment of the present invention.
Figure 3:
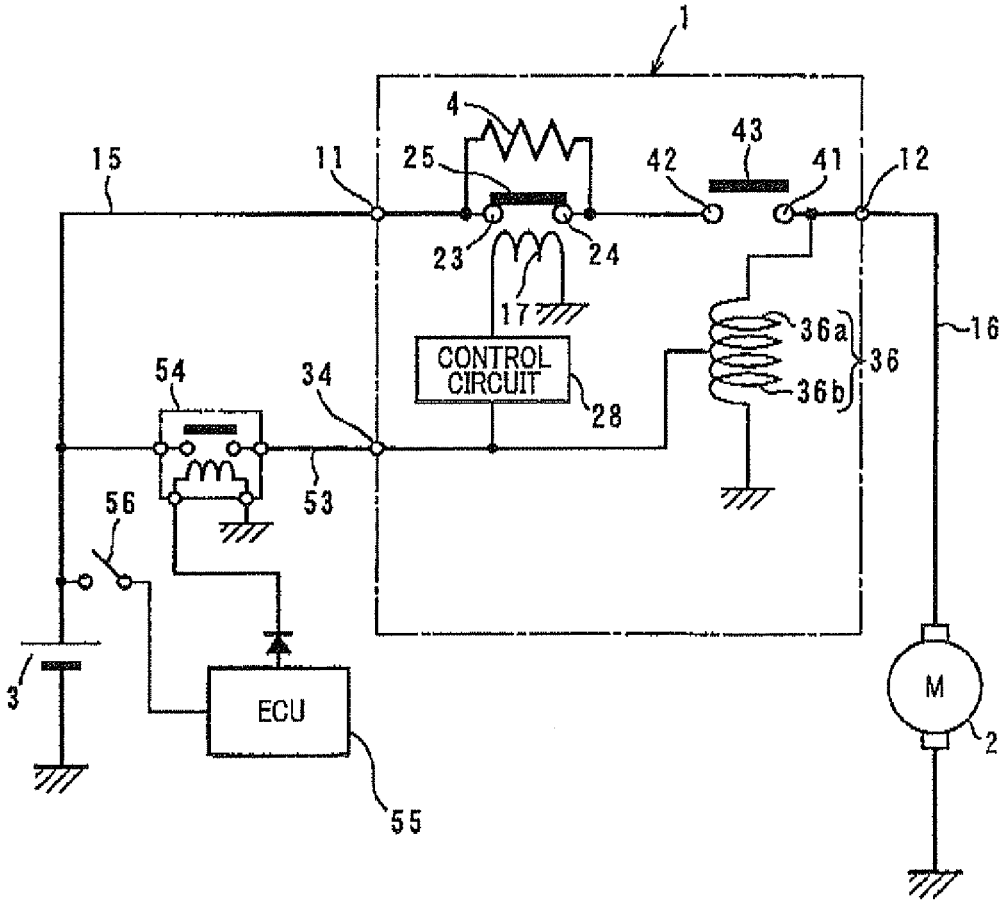
FIG. 3 is a circuit diagram of the apparatus of FIG. 1.

As shown in FIG. 1 and FIG. 3, a switching apparatus for a starter 1 in accordance with the first embodiment of the present invention comprises a resistor 4 adapted to suppress a startup current to be applied from a battery 3 to a motor 2 when the starter motor (hereinafter, referred to as a motor 2) is started, an electromagnetic relay 5 adapted to switch between an energizing path (higher-resistance energizing path) through the resistor 4 and an energizing path (lower-resistance energizing path) that bypasses the resistor 4; and an electromagnetic switch 6 adapted to push a pinion of the starter (not shown) toward a ring gear of the engine and turn on/off an energization current of the motor 2.

Figure 2:
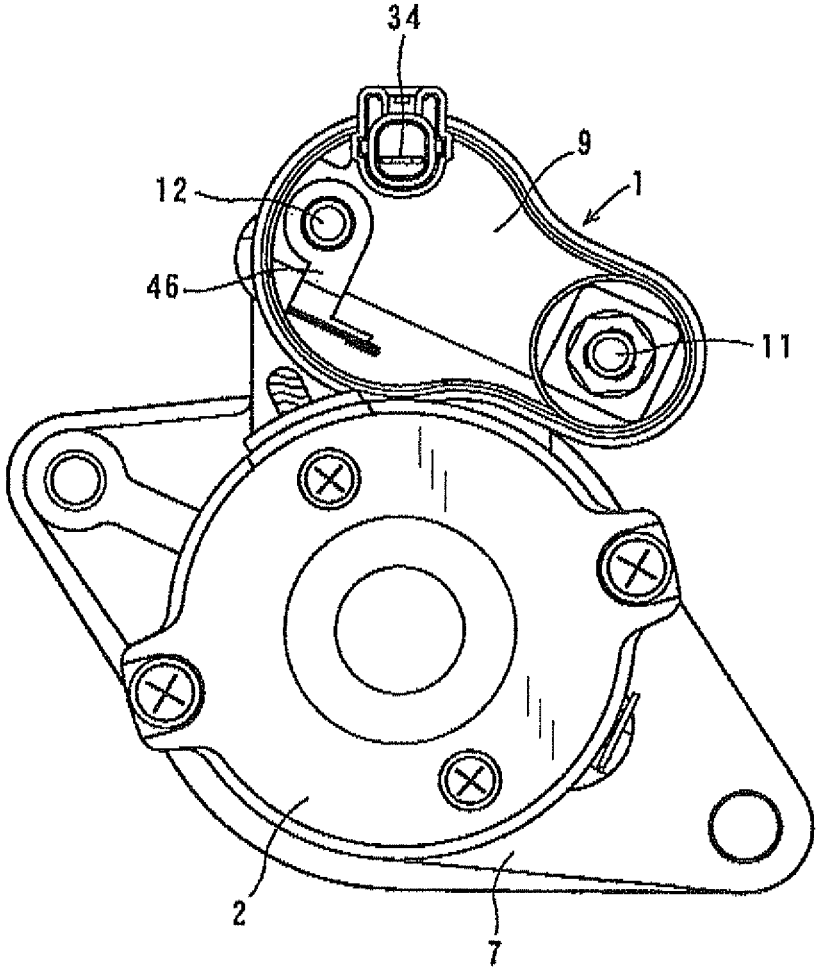
FIG. 2 is a posterior plan view of the apparatus of FIG. 1, viewed in the axial direction.

The apparatus 1 includes a single housing, inside which the resistor 4, the electromagnetic relay 5 and the electromagnetic switch 6 are integrally accommodated, and is fixed to a starter housing 7 radially outside and in proximity to the motor 2, as shown in FIG. 2.

There will now be explained an exemplary structure of the switching apparatus for the starter 1 with reference to FIG. 1 and FIG. 2.

A) The housing of the apparatus 1 is composed of a frame 8 with a bottom surface at one end (on the left hand side of FIG. 1) and an opening at the other end in the axial direction, and a contact cover 9 that covers the opening of the bottomed frame 8.

The bottomed frame 8 is a magnetic metal (e.g., iron) frame, and also functions as a magnetic yoke for an electromagnetic relay 5 and an electromagnetic switch 6. The bottomed frame 8 is formed, for example, by drawing a metal material.

The bottom surface of the bottomed frame 8 is provided on the electromagnetic switch 6 side with a cylindrical hole having a diameter slightly larger than that of the plunger 10 such that the plunger 10 is movable in the axial direction (the right and left directions of FIG. 1).

The contact cover 9 is made of resin to assure an electrical insulating property, and has a cylindrical body with a bottom at one end (i.e., on the right hand side of FIG. 1). The other end of the cylindrical body of the contact cover 9 is inserted into the opening of the bottomed frame 8 to wholly cover the opening, and is fixed to the opening of the bottomed frame 8 by swaging the opening along a partial or whole outer circumference of the inserted end of the body of the contact cover 9. The contact cover 9 is provided with two external connection terminals 11, 12 to be electrically connected to a motor circuit for supplying electrical power from the battery 3 to the motor 2.

There is provided a seal member (not shown), such as an O-ring, between the contact cover 9 and the bottomed frame 8, thereby preventing water or the like from infiltrating from the external of the apparatus 1.

The two external connection terminals 11, 12 are each bolt-shaped with a male thread being formed on its outer circumference. An end portion of each bolt-shaped external connection terminal where the male thread is formed projects from the bottom surface of the contact cover 9 through a through-hole, and is fixed to the contact cover 9 by means of swaging washers 13, 14.

A battery cable 15 (see FIG. 3) is connected to one of the two external connection terminals 11, 12 (hereinafter, referred to as the B-terminal 11) so that electrical power can be supplied from the battery 3 via the battery cable 15. A motor lead wire 16 (see FIG. 3) is connected to the other external connection terminal (hereinafter, referred to as the M-terminal 12) so that electrical power can be supplied to the motor 2 via the motor lead wire 16.

B) The electromagnetic relay 5 comprises a relay coil 17 that forms a electromagnet by application of an electric current to the coil, a magnetic plate 18 disposed on one axial end of the relay coil 17, a partition wall plate 19 disposed on the other axial end of the relay coil 17, an inner yoke 20 disposed on the outer circumference of the relay coil 17 between the magnetic plate 18 and the partition wall plate 19, a fixed core 21 coupled to the partition wall plate 19 and disposed on the inner circumference of the relay coil 17, a movable core 22 that can move confronted with an end face (the left end face of FIG. 1) of the fixed core 21 along the inner circumferential surface of the relay coil 17 in the axial direction (the right and left directions of FIG. 1), a pair of fixed contacts 23, 24 connected to the motor circuit, a movable contact 25 that electrically connects and disconnects between the pair of fixed contacts 23, 24, a shaft 26 that transmits movement of the movable core 22 to the movable contact 25.

The relay coil 17 is composed of a resin bobbin 27 and a winding around the bobbin. One end of the winding is connected to the control circuit 28 (which will be described later), and the other end of the winding is, for example, welded to a surface of the partition wall plate 19 to be grounded via the partition wall plate 19.

The magnetic plate 18 is a magnetic metal (e.g., iron) plate, and is disposed along a radial direction (i.e., a vertical direction of FIG. 1) on one axial end side of the relay coil 17. The magnetic plate 18 is provided with a round hole with an inner diameter slightly larger than an outer diameter of the movable core 22 so that the movable core 22 can move in the axial direction.

Similar to the magnetic plate 18, the partition wall plate 19 is a magnetic metal (e.g., iron) plate, and is disposed along the radial direction on the other axial end side of the relay coil 17.

The inner yoke 20 is cylindrically arranged along the inner circumferential surface of the bottomed frame 8, and is magnetically interconnect between the magnetic plate 18 and the partition wall plate 19. Since a plate thickness of the bottomed frame 8 that also functions as a magnetic yoke is relatively thinner compared with the magnetic plate 18 and the partition wall plate 19, cylindrically arranging the inner yoke 20 on the inner circumference of the bottomed frame 8 can increase the cross-sectional area of the magnetic yoke.

The fixed core 21 is cylindrically-shaped, and forms a continuous magnetic passage in combination with the partition wall plate 19 through its one end on the anti-plunger side (i.e., on the right side of FIG. 1) being mechanically coupled to the partition wall plate 19 (for example, by press fitting).

When the relay coil 17 is energized, the fixed core 21 is magnetized to attract the movable core 22 toward the fixed core, and the movable core 22 moves in the right direction of FIG. 1. When the energization is stopped, the movable core 22 will be pushed back toward its set position (on the anti-fixed-core side) by reaction force of the return spring 29. The movable core 22 is, for example, substantially H-shaped in the cross section (as shown in FIG. 1) taken along the axial direction through the radial center. Intentionally providing concave portions on both axial end sides to be substantially H-shaped makes it possible to trim weight of the apparatus.

There is a spacer member 30 made of a magnetically insulating material, such as resin or rubber, between the movable core 22 pushed back to its set-position and the bottom surface of the bottomed frame 8.

A pair of fixed contacts 23, 24 are a relay contact of the present invention that composes a fixed contact 23 fixed to B-terminal 11 and a fixed contact 24 fixed to the inner end surface of the contact cover 9 by the screw 31. The fixed contact 23 is formed by using, for example, a rectangular metal plate (e.g., a copper plate) and then bending the plate on both sides in the longitudinal direction by about 90 degrees, such that one bent end portion is confronted with the movable contact 25 to be the contact part 23*a* and the other bent end portion is connected to B-terminal 11 to be a connection part 23*b*. Preferably, the contact part 23*a* is shorter than the connection part 23*b*, and the connection part 23*b* is provided with a round hole through which the B-terminal 11 can penetrate the connection part 23*b*.

In other words, the fixed contact 23 is fixed between the head portion of the B-terminal 11 and the inner surface of the contact cover 9 by penetrating the B-terminal 11 through the round hole of the connection part 23*b* such that the connection part 23*b* and the contact part 23*a* are arranged at different positions in the axial direction, and the contact part 23*a* is lapped over the connection part 23*b* in the radial direction. Using the fixed contact 23 enables the central axis of the B-terminal 11 to be in line with the central axis of the relay coil 17.

Similar to the fixed contact 23, the fixed contact 24 has a contact part 24*a* confronted with the movable contact 25. The contact parts 23*a*, 24*a* are both disposed on the same plane perpendicular to the axial direction of the relay coil 17, and there is ensued a predetermined special gap between the contact parts 23*a*, 24*a*.

The movable contact 25 is disposed on the anti-movable core side (on the right side of FIG. 1) relative to the contact parts 23*a*, 24*a* of the pair of fixed contacts 23, 24. The movable contact 25 is adapted to be pushed against the contact parts 23*a*, 24*a* of the pair of fixed contacts 23, 24 by load of the contact spring 32 when the relay coil 17 is not energized or is in a non-excited state, thereby enabling the pair of the fixed contacts 23, 24 to be energized through the movable contact 25 for the relay contact to be turned on.

When the relay coil 17 is energized (excited), the movable core 22 is attracted toward the fixed core 21, and its movement is transmitted to the movable contact 25 via the shaft 26. Accordingly, the movable contact 25 moves toward the right hand side of FIG. 1 while pushing and contracting the contact spring 32, and then becomes separate from the contact parts 23*a*, 24*a* of the pair of the fixed contacts 23, 24, thereby enabling the relay contact to be turned off. Therefore, the electromagnetic relay 5 has a normally-closed contact point structure in which the relay contact is closed whenever the relay coil 17 is in a non-excited state.

The shaft 26 is a bar-shaped resin member, and is distinct from the movable core 22. The shaft 26 is disposed along the axial direction through a hollow hole composed of the inner-circumference of a cylindrical guide member 33 inserted into a hollow hole of the fixed core 21.

There is provided a flange 26*a* protruding in the radial direction at one end of the shaft 26, which is engaged with one of the concave portions of the movable core 22. The end face (on the anti-movable core side) at the other end of the shaft 26 is configured to be separate from the movable contact 25 with an air gap between the other end of the shaft 26 and the movable contact 25 whenever the relay coil 17 is in a non-excited state, as shown in FIG. 1. The other end face of the shaft 26, however, may be gently in contact with a confronted face of the movable contact 25 unless the contact spring 32 affects the contact pressure between the movable contact 25 and the contact parts 23*a*, 24*a* of the pair of the fixed contact 23, 24.

The return spring 29 is provided on the outer circumference of the shaft 26, where one end of the return spring 29 is supported by the flange 26*a* of the shaft 26 and the other end is supported by the axial end face of the guide member 33. This enables the shaft 26 to be pushed against the movable core 22 by load of the return spring 29 with the flange 26*a* being engaged with the concave portion of the movable core 22.

The resin guide member 33 is formed together with the resin bobbin 27 for the relay coil 17. In other words, the bobbin 27 and the guide member 33 are integrally formed with the fixed core 21 being inserted between them.

The control circuit 28 is adapted to control a time period during which the motor 2 is energized via the resistor 4 when the motor 2 is started, i.e., a time period during which an electric current flows through the resistor 4, by controlling the excitation state of the relay coil 17, and takes a form of, for example, an encapsulated integrated circuit (IC). The control circuit 28 is accommodated inside the housing of the switching apparatus for the starter 1, and is, for example, molded of resin in close contact with the anti-coil side surface of the partition wall plate 19, as shown in FIG. 1.

The control circuit 28 is connected to a signal terminal (not shown), a tip section of which is extracted from the inside to the outside of the contact cover 9 as a switch terminal 34 (see FIG. 2). In some embodiments, the signal terminal and the switch terminal 34 may be individual members, and may be electrically connected to each other within the housing.

C) The resistor 4 is provided in an inner space of the contact cover 9, and is connected to one fixed contact 23 and the other fixed contact 24 of the relay contact. In other words, one end of the resistor 4 is electrically connected to and mechanically coupled (welded) to one fixed contact 23 and the other end of the resistor 4 is electrically connected to and mechanically coupled (welded) to the other fixed contact 24. With this configuration, when the relay contact is opened (i.e., the movable contact 25 becomes separate from the pair of fixed contact 23, 24), there will be formed a higher-resistance energizing path from the battery 3 to the motor 2 through the resistor 4. On the other hand, when the relay contact is closed (i.e., the movable contact 25 becomes in contact with the pair of fixed contact 23, 24), there will be formed a lower-resistance energizing path from the battery 3 to the motor 2 (through the relay contact) which bypasses the resistor 4.

Accordingly, the resistor 4 is provided between an inner circumferential surface of the contact cover 9 and an surface of the resin member 35 (see FIG. 1) with a predetermined gap therebetween so that the resistor 4 is not in contact with the outer circumferential surface of the shaft 26, and the resin contact cover 9 and the resin member 35 for molding the control circuit 28 are not thermally damaged by the glowing (or hot) resistor 4 during energization.

D) The electromagnetic switch 6 comprises a magnet coil 36 that forms an electromagnet when energized, a magnetic plate 37 disposed at one end of the magnet coil 36 in the axial direction, a partition wall plate 38 disposed at the other end of the magnet coil 36 in the axial direction, an inner yoke 39 disposed on the outer circumference of the magnet coil 36 between the magnetic plate 37 and the partition wall plate 38, a fixed core 40 disposed on the inner circumference of magnet coil 36 and coupled to the partition wall plate 38, the plunger 10 that is movable confronted with the axial end face (the left end face in FIG. 1) of the fixed core 40 along the direction of the shaft axis (the right and left directions of FIG. 1), a pair of fixed contacts 41, 42 connected to the motor circuit, a movable contact 43 that connects and disconnects between the pair of the fixed contacts 41, 42, and a rod 44 that transmits movement of the plunger 10 to the movable contact 43.

The electromagnetic switch 6 is provided in parallel with the electromagnetic relay 5. In other words, the central axis of the magnet coil 36 is disposed in parallel with the central axis of the relay coil 17. Further, the magnet coil 36 and the relay coil 17 are disposed at the same axial position, and their axial lengths are also substantially same.

The magnet coil 36 is composed of two concentric coils which are wound around the resin bobbin 45 (an attracting coil 36*a* as an Inner layer and a holding coil 36*b* as an outer layer). As shown in FIG. 3, one end of the attracting coil 36*a* is connected to the switch terminal 34, and the other end of the attracting coil 36*a* is connected to, for example, a connection terminal (not shown) within the housing. And one end of the connection terminal is extracted from the inner bottom to the outside of the contact cover 9, and is electrically connected to the M-terminal 12 by means of the metallic connection plate 46.

One end of the holding coil 36*b* and one end of the attracting coil 36*a* are both connected to the switch terminal 34. The other end of the holding coil 36*b* is, for example, welded to a surface of the partition wall plate 38, and is grounded via the partition wall plate 38.

The magnetic plate 37 is a magnetic metal (e.g., iron) plate, and is disposed along a radial direction (i.e., the vertical direction of FIG. 1) on one axial end side of the magnet coil 36. The magnetic plate 37 is provided with a round hole with an inner diameter slightly larger than an outer diameter of the plunger 10 so that the plunger 10 can move in the axial direction.

Similar to the magnetic plate 37, the partition wall plate 38 is a magnetic metal (e.g., iron) plate, and is disposed along the radial direction on the other axial end side of the magnet coil 36.

In addition, the magnetic plate 18 used for the electromagnetic relay 5 and the magnetic plate 37 used for the electromagnetic switch 6 may be individual components, or may share a same single component. Similarly, the partition wall plate 19 used for electromagnetic relay 5 and the partition wall plate 38 used for the electromagnetic switch 6 may be individual components, or may share a same single component. In other words, as for the electromagnetic relay 5 and the electromagnetic switch 6, the magnetic plates 18, 37 may be formed of a single continuous metallic plate. Similarly, the partition wall plates 19, 38 may be formed of a single continuous metallic plate.

The inner yoke 39 is cylindrically arranged along the inner circumferential surface of the bottomed frame 8, and magnetically interconnects between the magnetic plate 37 and the partition wall plate 38. Similarly to the electromagnetic relay 5 case, since a plate thickness of the bottomed frame 8 that also functions as a magnetic yoke is relatively thinner compared with the magnetic plate 37 and the partition wall plate 38, cylindrically arranging the inner yoke 20 on the inner circumference of the bottomed frame 8 can increase the cross-sectional area of the magnetic yoke.

The fixed core 40 is mechanically coupled to the partition wall plate 38 (for example, by press fitting) to form a continuous magnetic passage in combination with the partition wall plate 38. In addition, the fixed core 40 has an annular body having a round hole in the radial center to axially pass the rod 44 therethrough.

When the magnet coil 36 is energized, the fixed core 40 is magnetized to attract the plunger 10 toward the fixed core, and then the plunger 10 moves in the right direction of FIG. 1. When the energization of the magnet coil 36 is stopped, the plunger 10 will be pushed back to its set position (on the anti-fixed-core side) by reaction force of the return spring 47 arranged between the fixed core 40 and the plunger 10.

The plunger 10 is substantially cylindrically-shaped with a cylindrical blind hole in the radial center of the plunger. The cylindrical hole is opened at one end of the plunger 10, and is bottomed at the other end of the plunger 10. There is inserted into the cylindrical hole a joint 48 for transmitting the movement of the plunger 10 to a shift lever (not shown) to move a pinion and a drive spring 49 which will be described later.

The joint 48 is bar-shaped. An engagement groove 48*a* to be engaged with one end of the shift lever is formed at one end of the joint 48 that protrudes from the cylindrical hole of the plunger 10, and a flange 48*b* is provided at the other end of the joint 48. The flange 48*b* has an outer diameter such that the flange 48*b* is movable on the inner circumference of the cylindrical (blind) hole in the axial direction, and is pushed against the bottom of the cylindrical hole by reaction force of the drive spring 49.

The pinion moves in the anti-motor direction (i.e., toward the ring gear side) via the shift lever accompanied by the movement of the plunger 10, and then an end face of the pinion is brought into contact with an end face of the ring gear. At the same time, the drive spring 49 is contracted to store repulsive force for the pinion to be engaged with the ring gear during the plunger 10 being absorbed to the fixed core 40.

The pair of the fixed contacts 41, 42 function as the main contact of the present invention, and consist of one fixed contact 41 fixed to the M-terminal 12 and the other fixed contact 42 fixed on the inner end surface of the contact cover 9 by means of a screw 31. As shown in FIG. 1, the fixed contact 42 is formed of the same component shared with the fixed contact 24 used for the relay contact. Alternatively, the fixed contact 24 for the relay contact and the fixed contact 42 for the main contact may be individual components, and may be electrically connected to and mechanically coupled (welded) to each other.

The movable contact 43 is retained on the outer circumference of the rod 44 via an insulator 50 formed of an electrically insulating material, and is biased toward the anti-plunger direction (the right direction of FIG. 1) by the contact spring 51 to contact a retaining washer 52 at one end of the rod 44.

The main contact is turned on by the movable contact 43 being biased against the pair of the fixed contacts 41, 42 to be in contact therewith by the contact spring 51 so that both the fixed contacts 41, 42 are energized through the movable contact 43, and is are turned off by the movable contact 43 becoming separate from the pair of fixed contacts 41, 42.

The rod 44 is, for example, metallic (made of iron), and has a flange at one end of the rod on the plunger side. The flange is mechanically coupled (e.g., welded) to the end face of the plunger 10.

The contact spring 51 is provided on the outer circumference of the rod 44. One end of the contact spring 51 is supported by the flange of the rod 44, and the other end of the contact spring 51 is supported by the insulator 50.

As shown in FIG. 3, the switch terminal 34 is connected to the electrical wiring 53 for applying an excitation current from the battery 3 to the relay coil 17 for the electromagnetic relay 5 and to the magnet coil 36 for the electromagnetic switch 6. In other words, in the switching apparatus for the starter 1 of the present so embodiment, the switch terminal 34 for the relay coil 17 and the switch terminal 34 for the magnet coil 36 may not be mutually individual components, but may share the same single switch terminal 34.

The starter relay 54 on the vehicle side is inserted along the electrical wiring 53, switching operation of the starter relay 54 is controlled by the electrical control unit (ECU) 55.

The ECU 55 is activated when the ignition switch (hereinafter, referred to as IG-switch 56) is turned on for electrical power to be supplied from the battery 3 thereto.

There will now be explained operations of the switching apparatus for the starter 1.

When the ECU 55 is activated upon reception of an on-signal from the IG-switch 56, the starter relay 54 is tuned on by the drive signal outputted from the ECU 55. As a result, the magnet coil 36 for the electromagnetic switch 6 is energized by the battery 3, and then the plunger 10 is attracted to the magnetized fixed core 40. In conjunction with the movement of the plunger 10, the pinion moves to the anti-motor direction (the direction opposite to the direction toward the motor) via the shift lever while rotating together with a clutch (not shown) along a helical spline on the output shaft of the starter, and then stops once an end face of the pinion is brought into contact with an end face of the ring gear. Substantially at the same time (in practice, with a slight mechanical delay), the main contact is turned on.

It is occasionally possible that the pinion is smoothly engaged with the ring gear without the end face of the pinion being brought into contact with the end face of the ring gear. In most cases, the pinion stops once the end face of the pinion is brought into contact with the end face of the ring gear.

On the other hand, in the electromagnetic relay 5, after the starter relay 54 has been turned on, the drive signal for the relay coil 17 will be kept in an on-state by the Control circuit 28 for a predetermined time period (for example, 30-40 ms). Once the relay coil 17 is excited, the relay contact is turned off.

Once the relay contact is turned off, there will be formed a higher-resistance energizing path of the present invention from the battery 3 to the motor 2 through the resistor 4. The resistor 4 enables an electric current to be suppressed from flowing through the motor 2. Therefore, the motor 2 will rotate at a lower rotation speeds.

Once the pinion is engaged with the ring gear at such a lower rotation speed of the motor 2, the drive signal for the relay coil 17 is turned off by the control circuit 28. When the relay contact is turned on, there will be formed a lower-resistance energizing path of the present invention from the battery 3 to the motor 2 with both ends of the resistor 4 being short circuited. Accordingly, since the motor 2 is energized by the full voltage of the battery 3, the motor 2 rotates at a higher rotation speed. The rotational motion of the motor 2 is transmitted from the pinion to the ring gear for the engine to be cranked.

The switching apparatus for the starter 1 in accordance with the first embodiment of the present invention can prevent the "instantaneous interruption" due to terminal voltage reduction of the battery 3 from occurring, because the resistor 4 enables an electric current that flows into the motor 2 when the motor is started to be reduced. In particular, in a vehicle equipped with an idling stop device, this can prevent the instantaneous interruption from occurring every time the engine is restarted on a road, which leads to elimination of user's discomfort and insecurity. In addition, suppression of a startup current of the motor 2 can enlarge a life time of the main contact and a life time of a brush used for the motor 2. Since a rotation speed when the pinion is engaged with the ring gear is lowered and impact in the engagement is reduced, attrition between the pinion and the ring gear is effectively reduced, thereby enhancing durability.

The switching apparatus for the starter 1 of the first embodiment is configured such that the electromagnetic relay 5, the resistor 4, and the electromagnetic switch 6 are integrally stored in a single housing. Therefore, the entire switching apparatus 1 can be made compact.

In particular, as for the electromagnetic relay 5 and the electromagnetic switch 6, since the central axis of the relay coil 17 and the central axis of the magnet coil 36 are arranged in parallel with each other, a total length of the switching apparatus 1 can be significantly shortened, compared with cases where the electromagnetic relay 5 and the electromagnetic switch 6 are arranged in series in the axial direction.

In addition, the metallic bottomed frame 8 used for the housing of the switching apparatus 1 forms a magnetic yoke as a part of the magnetic circuit. Since the bottomed frame 8 as a part of the housing is used as a magnetic yoke for the electromagnetic relay 5 and the electromagnetic switch 6, the bottomed frame 8 and the magnetic yoke don't have to be individual components. This enables a radial dimension of the switching apparatus 1 to be shortened.

Regarding one fixed contact 23 fixed to the B-terminal 11 among a pair of fixed contacts 23, 24 that form the relay contact of the electromagnetic relay 5, the contact part 23*b* connected to the B-terminal 11 and the contact part 23*a* confronted with the movable contact 25 are arranged at different positions in the axial direction, and the contact part 23*a* is lapped over the connection part 23*b* in the radial direction. In other words, since the contact part 23*a* and the contact part 23*b* don't have to be arranged on the same plane, a radial space required to provide one of the fixed contacts 23 can be made small, compared with cases where the so contact part 23*a* and the connection part 23*b* of a plate-like fixed contact are arranged on the same plane.

This enables the central axis of the B-terminal 11 and the central axis of the relay coil 17 to be arranged on the same axis. On the other hand, when the plate-like fixed contact is used where the contact part 23*a* and the contact part 23*b* are arranged on the same plane, the B-terminal 11 is required to be arranged on the radially outer side relative to the central axis of the relay coil 17, which will read to increase of the radial dimension. In contrast, in the first embodiment, the central axis of the B-terminal 11 and the central axis of the relay coil 17 can be arranged on the same axis, which will not lead to increase of the radial dimension.

Since the axial position of the relay coil 17 and the axial position of the magnet coil 36 are substantially same, and the axial length of the relay coil 17 and the axial length of the magnet coil 36 are also substantially same, a shared component is used for a part of their magnetic circuit (s). For example, the magnetic plate 18 disposed on one axial end side of the relay coil 17 and the magnetic plate 37 disposed on one axial end side of the magnet coil 36 can share a single metallic plate. Similarly, the partition wall plate 19 disposed on the other axial end side of the relay coil 17 and the partition wall plate 38 disposed on the other axial end side of the magnet coil 36 can also share a single metallic plate. As described above, a shared component is used for a part of the magnetic circuit (s) formed on both or either one of axial end sides of the relay coil 17 and the magnet coil 36.

In addition, in the switching apparatus 1 of the first embodiment, since the relay contact of the electromagnetic relay 5 and the main contact of the electromagnetic switch 6 are arranged in series, the number of components can be reduced by integrally providing the other fixed contact 24 that forms the relay contact and the other fixed contact 42 that forms the main contact. Even in cases where the other fixed contact 24 used for the relay contact and the other fixed contact 42 used for the main contact are individual components, both fixed contacts 24, 42 can be electrically and mechanically connected within the housing. Therefore, it is not required to extract the external connection terminal to the external of the housing.

Besides the B-terminal 11 and the M-terminal 12 of the first embodiment, there are not required two more external connection terminals to electrically connect the other fixed contact 24 used for the relay contact and the other fixed contact 42 used for the main contact, and a cable to connect the external connection terminals. This enables the number of external connection terminals to be decreased from four to two. In addition, since it is possible to connect the battery 3 and the switching apparatus 1 with one battery cable 15, the number of cables can be reduced, compared with Japanese Patent Application Publication No. 2009-224315.

The switching apparatus 1 of the first embodiment includes the control circuit 28 that controls the time period during which the motor 2 is energized via the resistor 4 when the motor 2 is started, i.e., the time period during which the electrical current flows through the resistor 4. The control circuit 28 is stored in the housing. A dedicated housing for storing the control circuit 28 is not required. Therefore, costs can be reduced by the cost of the dedicated housing, and it is not required to reserve an installation space for the control circuit 28 external to the switching apparatus 1. As a result, no signal line connected to the control circuit 28 is exposed outside from the housing, and, for example, disconnection of the signal line due to external vibration (vibration of an engine and vibration in running) will not occur. Moreover, ensuring waterproofing of the housing of the switching apparatus 1 enables reliability and environment resistance to be improved.

As described above, in the switching apparatus 1 of the first so embodiment, besides a feature that the electromagnetic relay 5, the resistor 4 and the electromagnetic switch 6 are simply and integrally accommodated inside a single housing, the switching apparatus has the following features that:

the electromagnetic relay 5 and the electromagnetic switch 6 are arranged in parallel with each other;

the central axis of the B-terminal 11 and the central axis of the relay coil 17 are disposed on the same axis by devising a shape of the fixed contact 23 of the relay contact;

the bottomed frame 8 used for the housing is used for a magnetic yoke;

a shared component is used for a part of the magnetic circuit;

integrally providing the other fixed contact 24 used for the relay contact and the other fixed contact 42 used for the main contact can reduce the number of the external connection terminals to two, i.e., the B-terminal 11 and the M-terminal 12;

the control circuit 28 is molded of resin within the housing.

Accordingly, the switching apparatus 1 of the first embodiment provides the following advantages that:

downsizing the apparatus is achieved by effectively arranging the electromagnetic relay 5 and the electromagnetic switch 6, thereby improving an installation property;

shortening of operation processes is achieved by reducing the number of cables, thereby facilitating connectivity to the vehicle side; and the control circuit 28 is stored in the housing that can ensure waterproofing, thereby acquiring environment resistance.

Since the electromagnetic relay 5 used for the switching apparatus 1 has the normally-closed contact point structure, a higher-resistance energizing path from the battery 3 to the motor 2 through the resistor 4 is formed when the relay coil 17 is excited for the relay contact to be opened. In the presence of the higher-resistance energizing path, when the drive signal to the relay coil 17 is interrupted due to an abnormality such as an abnormality in the control system or an abnormality in the signal system, the relay contact is turned on, which leads to formation of a lower-resistance energizing path that bypasses the resistor 4. Even in cases where the drive signal to the relay coil 17 is interrupted due to an abnormality such as an abnormality in the control system or an abnormality in the signal system, since a normal energizing path (lower-resistance energizing path) that doesn't bypass the resistor 4 is ensured, the starter can be started.

In addition, when the drive signal to the relay coil 17 is interrupted for the relay contact to be turned on, since an electric current that flows through the resistor 4 is suppressed (or almost stopped), the resistor 4 will not abnormally generate heat, and meltdown of the resistor 4 can be avoided. After the system is restored, since the resistor 4 is not meltdown, the resistor 4 can be continued to be used without replacing the resistor 4 with a new one.

The resistor 4 of the first embodiment resides inside the contact cover 9. In other words, since the resistor 4 is not exposed outside from the contact cover 9, water causing erosion is prevented from adhering to the resistor 4, thereby enhancing durability. Further, even in cases where the resistor 4 is glowing due to long-term energization, external inflammable material will not be brought into contact with the resistor 4, thereby ensuring safety.

The resistor 4 is disposed between the inner circumferential surface of the contact cover 9 and the surface of the resin member 35 spaced apart from them with a predetermined distance such that the resistor 4 is not brought into contact with the outer circumferential surface of the shaft 26 used for the electromagnetic relay 5, and the resin contact cover 9 and the resin member 35 molding the control circuit 28 are not thermally damaged by the glowing resistor 4 (due to energization). Further, since the movable contact 25 used for the electromagnetic relay 5 is disposed on the anti-movable core side in the axial direction relative to the pair of contact parts 23*a*, 24*a* of the fixed contacts 23, 24, the resistor 4 will not be brought into direct contact with the movable contact 25, thereby enhancing reliability and safety of the switching apparatus 1.

(Second Embodiment)

The switching apparatus for the starter 1 in accordance with the second embodiment of the present invention is different from the switching apparatus 1 in accordance with the first embodiment of the present invention as described above in that in the second embodiment the electromagnetic switch 6 is of tandem-type. In other words, in the second embodiment, the function of the electromagnetic switch 6 for pushing the pinion and the function of the electromagnetic switch 6 for opening and closing (i.e., switching) the main contact are distinct from each other, and are individually controlled.

Since all the functions of the switching apparatus of the second embodiment are substantially same as those of the switching apparatus of the first embodiment except for the above functions of the electromagnetic switch 6, only the above functions will be explained below with reference to FIG. 4 in which like numbers refer to like elements.

In the switching apparatus 1 of the second embodiment, the electromagnetic switch 6 is composed of a pinion-pushing solenoid 57 for pushing the pinion and a motor-energizing solenoid 58 for opening and dosing the main contact.

The pinion-pushing solenoid 57 is responsible for and dedicated to the function for pushing the pinion, and comprises a first magnet coil 59 that forms an electromagnet when energized, a fixed core 60 that is magnetized when the first magnet coil 59 is energized, and a first plunger 61 that is movable, confronted with the fixed core 60, on the inner circumference of the first magnet coil 59 in the axial direction. The pinion-pushing solenoid 57 is operative to push the pinion in conjunction with movement of the first plunger 61.

The motor-energizing solenoid 58 is responsible for and dedicated to the function for opening and closing the main contact, and comprises the second magnet coil 62 that forms an electromagnet when energized, a fixed core 60 that is magnetized when the second magnet coil 62 is energized, a second plunger 63 that is movable, confronted with the fixed core 60, on the inner circumference of the second magnet coif 62 in the axial direction. The motor-energizing solenoid 58 is operative to open and close the main contact in conjunction with movement of the second plunger 63.

Figure 4:
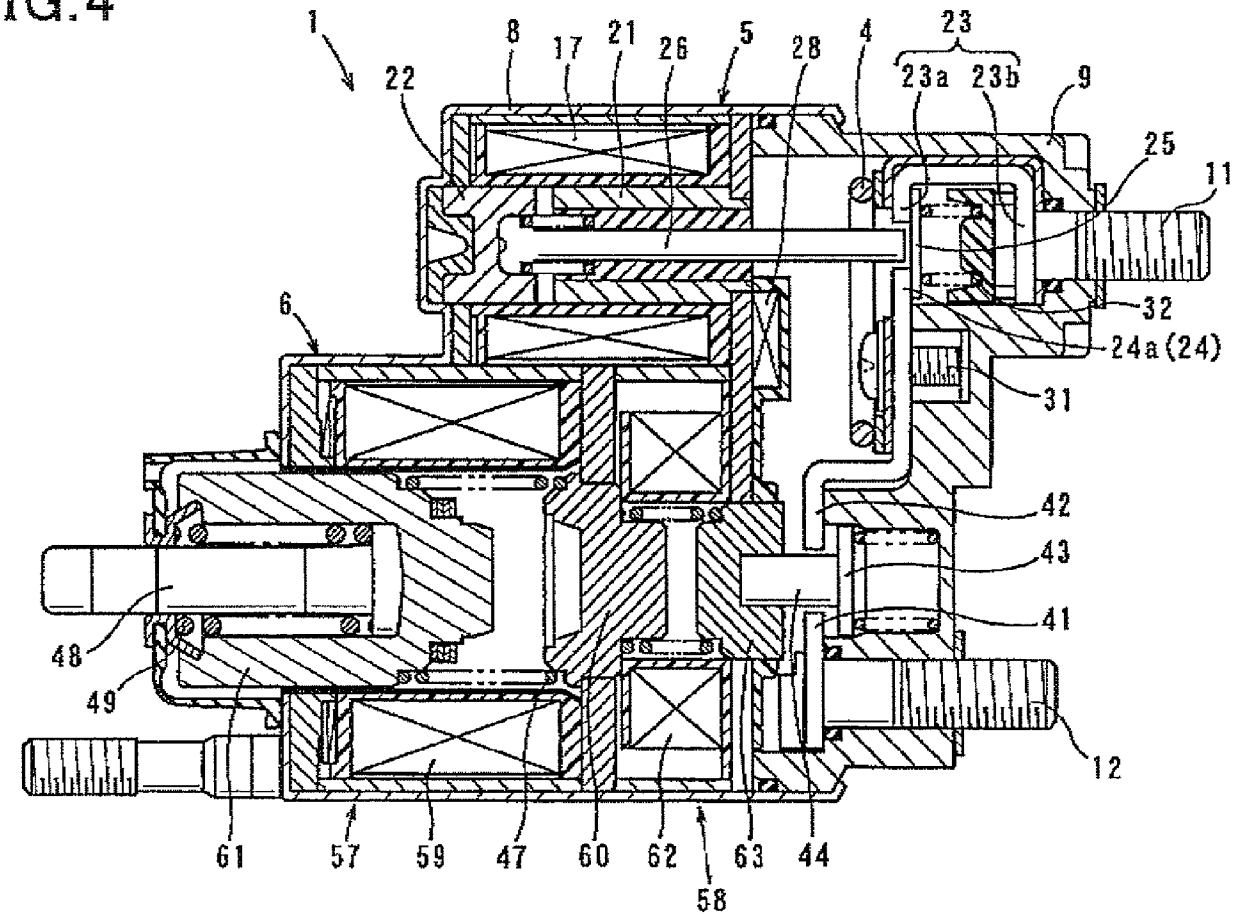
FIG. 4 is a cross sectional view of a switching apparatus for a starter in accordance with a second embodiment of the present invention.

The pinion-pushing solenoid 57 and the motor-energizing solenoid 58 are arranged in series with each other in the axial direction (in the right and left directions in FIG. 4). In other words, the central axis of the first magnet coil 59 and the central axis of the second magnet coil 62 are arranged on the same axis. This enables components of the pinion-pushing solenoid and components of the motor-energizing solenoid to be sequentially assembled in the axial direction, which leads to a shortened assembling process. In addition, there is disposed between the first plunger 61 and the second plunger 63 a common fixed core 60 for both the solenoids 57, 58. Therefore, the first magnet coil 59 is excited for the fixed core 60 to be magnetized, and then the first plunger 61 is attracted to the fixed core 60 to move in the right direction of FIG. 4. Similarly, the second magnet coil 52 is excited for the fixed core 60 to be magnetized, and then the second plunger 63 is attracted to the fixed core 60 to move in the left direction of FIG. 4. Unlike the electromagnetic switch 6 of the first embodiment, the movable contact 43 that opens and closes the main contact is arranged on the anti-plunger side (on the right side of FIG. 4) relative to both the fixed contacts 41, 42, and is pressed against the apical surface of the rod 44 by the contact spring 51. In the second embodiment, the rod 44 is made of resin with an electrically insulating property.

Figure 5:
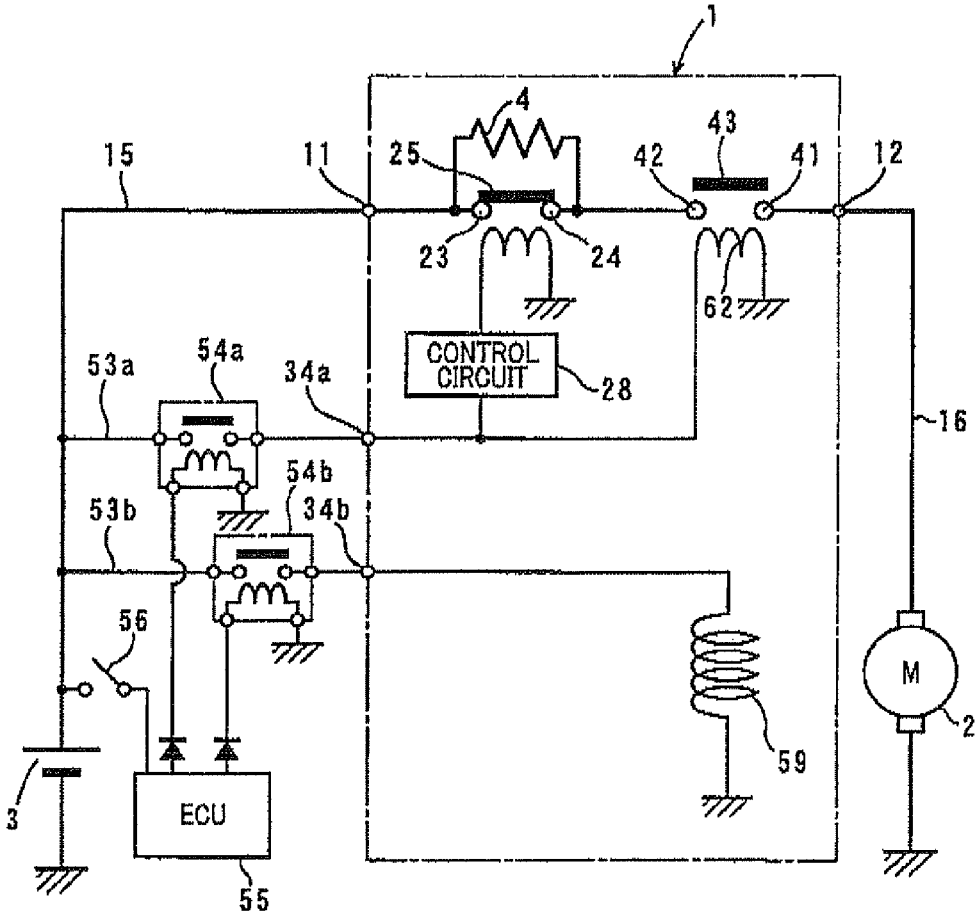
FIG. 5 is a circuit diagram of the apparatus of FIG. 4.

The contact cover 9 (see FIG. 1) is provided with two switch terminals 34*a*, 34*b*. As shown in FIG. 5, the second magnet coil 62 is connected to one switch terminal 34*a*, and the first magnet coil 59 is connected to the other switch terminal 34*b*.

The relay coil 17 of the electromagnetic relay 5 is connected to the switch terminal 34*a* via the control circuit 28. In other words, the second magnet coil 62 and the relay coil 17 are interconnected to share the single and common switch terminal 34*a*.

The switch terminals 34*a*, 34*b* are connected to the electrical wirings 53*a*, 53*b* for applying an excitation current from the battery 3, respectively. A first starter relay 54*a* and a second starter relay 54*b* are inserted along the electrical wiring 53*a*, 53*b*, respectively.

Switching operation of the first and second starter relays 54*a*, 54*b* is controlled by the ECU 55 (see FIG. 5). Similar to the first embodiment, a time period during which the motor 2 being energized through the resistor 4 when started, i.e., an energization time period during which an electric current being following through the resistor 4, is controlled by the control circuit 28 controlling the excited state of the relay coil 17.

There will now be explained operations of the switching apparatus for the starter 1 in accordance with the second embodiment of the present invention.

Once the ECU 55 is activated on reception of an on-signal from the IG-switch 56, the first and second starter relays 54*a*, 54*b* are simultaneously turned on by the drive signal outputted from the ECU 55. As a result, the pinion moves to the anti-Motor direction in the axial direction through the operation of the pinion-pushing solenoid 57 including the first magnet coil 59. Once the pinion is brought in contact with the ring gear, the pinion stops its movement. At the same time, the main contact is turned on through the operation of the motor-energizing solenoid 58 including the second magnet coil 62.

On the other hand, in the electromagnetic relay 5, once the first starter relay 54*a* is turned on, the drive signal for the relay coil 17 is kept in the on-state by the control circuit 28 for a predetermined time period (e.g., 30-40 ms). Accordingly, the relay coil 17 is magnetized for the relay contact to be turned off and kept in the off-state during that time period.

Once the relay contact is turned off, there will be formed a higher-resistance energizing path from the battery 3 to the motor 2 through the resistor 4. The resistor 4 enables an electric current flowing through the motor 2 to be reduced. Accordingly, the motor 2 rotates at a slow rotation speed.

Owing to the lower rotation speed of the motor 2, once the pinion is brought in contact with the ring gear, the drive signal for the relay coil 17 is turned off by the control circuit 28. At the same time, both ends of the resistor 4 are short circuited, and then there will be formed a lower-resistance energizing path. Since the motor 2 is energized by the full voltage of the battery 3, the motor 2 rotates at a higher rotation speed. The rotational motion of the motor 2 is transmitted from the pinion to the ring gear for the engine to be cranked.

(Third Embodiment)

Similar to the switching apparatus for the starter 1 in accordance with the first embodiment, the switching apparatus in accordance with the third embodiment includes the electromagnetic switch 6 that pushes the pinion and switches (i.e., opens and closes) the main contact in conjunction with movement of the plunger 10. Unlike the first embodiment, however, the electromagnetic relay 5 of the third embodiment has a normally-open contact point structure. That is, once the relay coil 17 is energized, the relay contact is turned on.

Figure 6:
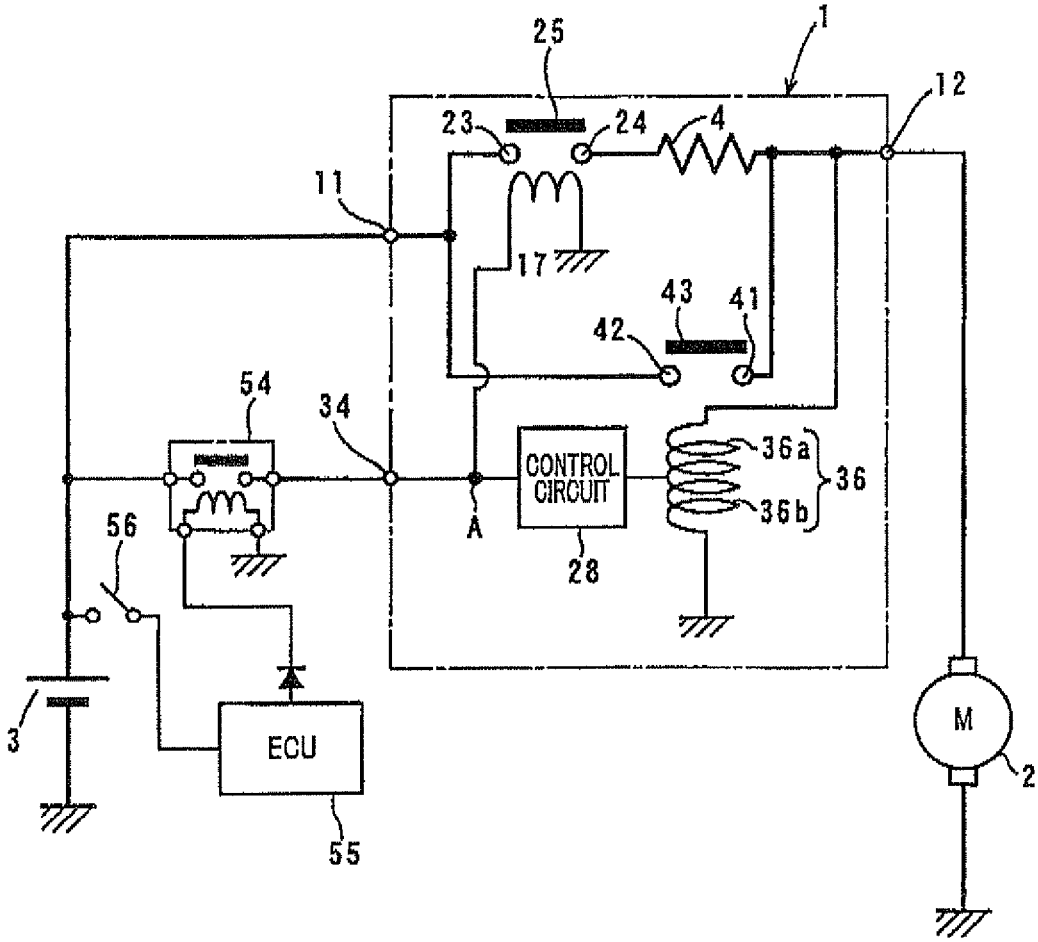
FIG. 6 is a circuit diagram of a switching apparatus for a starter in accordance with a third embodiment of the present invention.

In the first embodiment, the relay contact and the main contact are arranged in series with each other between the B-terminal 11 and the M-terminal 12, and the resistor 4 is connected in series with the relay contact. The resistor 4 and the relay contact are reversely arranged. In other words, the resistor 4 is on a higher-voltage side of the relay contact, while the relay contact is on a lower-voltage side of the relay contact in FIG. 6.

Similar to the first embodiment, the switching apparatus of the third embodiment also includes the control circuit 28 that controls a time period (an energization time) during which an electric current flows through the resistor 4 when the motor 2 is started. In the third embodiment, however, the control circuit 28 is arranged between the magnet coil 36 and a connection point A where the relay coil 17 is connected to the switch terminal 34, and there is provided a delay time between timing for energizing the relay coil 17 and timing for energizing the magnet coil 36. In other words, the control circuit 28 is operative to energize the magnet coil 36 a predetermined delay time after having energized the relay coil 17.

There will now be explained operations of the switching apparatus for the starter 1 in accordance with the third embodiment of the present invention.

Once the ECU 55 is activated on reception of an on-signal from the IG-switch 56, the starter relay 54 is turned on by the drive signal outputted from the ECU 55. The relay coil 17 is magnetized for the relay contact to be turned on.

On the other hand, through the delaying function of the control circuit 28, the magnet coil 36 is energized a predetermined delay time after the energization of the relay coil 17. Thus, the main contact is kept in the off-state for a predetermined time period (i.e., the delay time) after the relay contact has been turned on.

Once the relay contact is turned on, there will be formed a higher-resistance energizing path from the battery 3 to the motor 2 through the resistor 4. The resistor 4 enables an electric current flowing through the motor 2 to be reduced. Accordingly, the motor 2 rotates at a slow rotation speed.

The magnet coil 36 is energized after the delay time has elapsed set by the control circuit 28. The pinion moves in the anti-motor direction to be engaged with the ring gear, and then the main contact is turned on a short mechanical delay time after the engagement of the pinion with the ring gear. There will then be formed a lower-resistance energizing path. Since the motor 2 is energized by the full voltage of the battery 3, the motor 2 rotates at a higher rotation speed. The rotational motion of the motor 2 is transmitted from the pinion to the ring gear for the engine to be cranked.

(Forth Embodiment)

Similar to the switching apparatus for the starter 1 in accordance with the third embodiment, the switching apparatus in accordance with the forth embodiment includes the electromagnetic relay 5 with the normally-open contact point structure and the electromagnetic switch 6 that pushes the pinion and switches (i.e., opens and closes) the main contact. In addition, the relay contact and the main contact are arranged in parallel with each other, and the resistor 4 is connected in series with the relay contact (see FIG. 7).

Unlike the third embodiment, however, there is not provided the dedicated control circuit 28 that controls the time period during which the electric current flows through the resistor 4. In the fourth embodiment, the external ECU 55 is responsible for the delaying function (for setting a delay time between timing for energizing the relay coil 17 and timing for energizing the magnet coil 36) in place of the control circuit 28.

Figure 7:
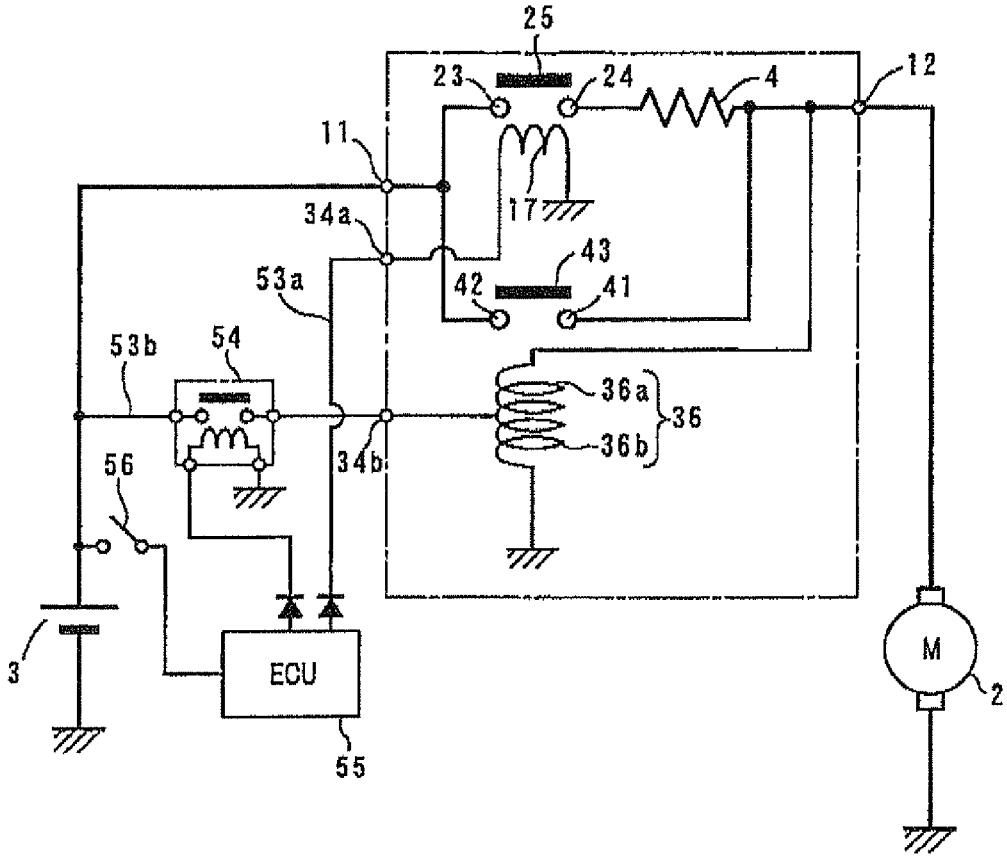
FIG. 7 is a circuit diagram of a switching apparatus for a starter in accordance with a forth embodiment of the present invention.

As shown in FIG. 7, in the switching apparatus of the forth embodiment, there are provided two switch terminals 34*a*, 34*b*. One switch terminal 34*a* is connected to the relay coil 17, and the other switch terminal 34*b* is connected to the magnet coil 36.

The switch terminal 34*a* is also connected to the electrical wiring 53*a* for applying an excitation current to the relay coil 17 through the ECU 55. The other switch terminal 34*b* is also connected to the electrical wiring 53*b* for applying an excitation current from the battery 3 to the magnet coil 36. The starter relay 54 is inserted along the electrical wiring 53*b*, and the switching operation of the starter relay 54 is controlled by the ECU 55.

There will now be explained operations of the switching apparatus for the starter 1 in accordance with the forth embodiment of the present invention.

Once the ECU 55 is activated on reception of an on-signal from the IG-switch 56, the ECU 55 outputs a drive signal to the electromagnetic relay 5 for energizing the relay coil 17. The starter relay 54 is turned on by the ECU 55 a predetermined time period after the drive signal has been transmitted to the electromagnetic relay 5. Therefore, the magnet coil 36 will not be excited until the predetermined time period has elapsed since the energization of the relay coil 17. The main contact is kept in the off-state for the predetermined time period.

Once the relay coil 17 is energized for the relay contact to be turned on, there will be formed a higher-resistance energizing path from the battery 3 to the motor 2 through the resistor 4. The resistor 4 enables an electric current flowing through the motor 2 to be reduced. Accordingly, the motor 2 rotates at a slow rotation speed.

The starter relay 54 is turned on by the drive signal outputted from the ECU 55 a predetermined delay time after the energization of the relay coil 17. Once the electromagnet is formed through the excitation current flowing from the battery 3 to the magnet coil 36, the plunger 10 moves in the axial direction for the pinion to be engaged with the ring gear. Once the pinion has been is engaged with the ring gear, the main contact is turned on a slightly short mechanical delay time after the engagement of the pinion with the ring gear. There will then be formed a lower-resistance energizing path. Since the motor 2 is energized by the full voltage of the battery 3, the motor 2 rotates at a higher rotation speed. The rotational motion of the motor 2 is transmitted from the pinion to the ring gear for the engine to be cranked.

(Fifth Embodiment)

The switching apparatus for the starter 1 in accordance with the fifth embodiment includes the electromagnetic relay 5 with the normally-open contact point structure as in the third and fourth embodiments, and the electromagnetic switch 6 of the second embodiment, i.e., the tandem-type electromagnetic switch 6 that comprises the pinion-pushing solenoid 57 for pushing the pinion and the motor-energizing solenoid 58 for opening and closing the main contact. Since the structure of the electromagnetic switch 6 (the pinion-pushing solenoid 57+the motor-energizing solenoid 58) is same as that of the electromagnetic switch 6 of the second embodiment, its explanation will not be repeated below.

Figure 8:
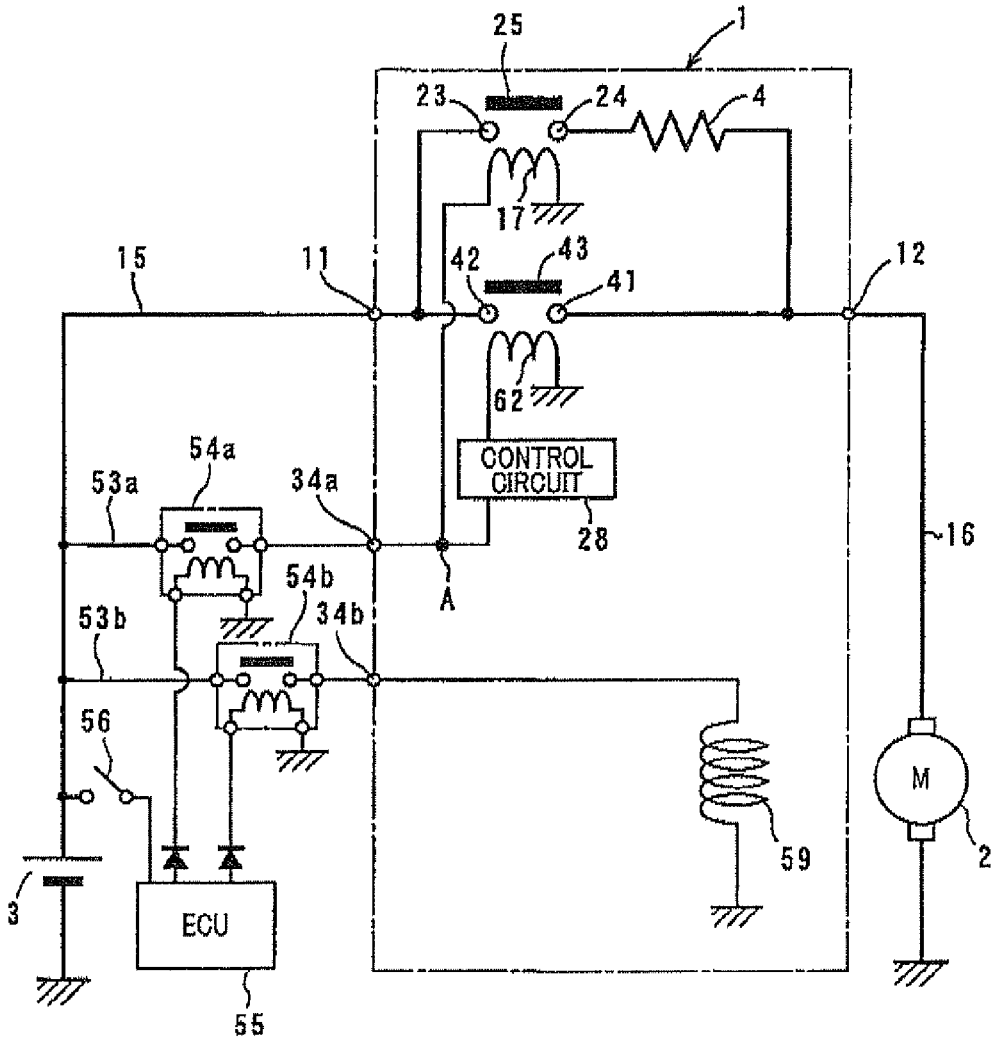
FIG. 8 is a circuit diagram of a switching apparatus for a starter in accordance with a fifth embodiment of the present invention.

Similar to the third and fourth embodiments, the relay contact and the main contact are arranged in parallel with each other between the B-terminal 11 and the M-terminal 12, and the resistor 4 is connected in series with the relay contact (see FIG. 8).

Similar to the second embodiment, there are provided two switch terminals 34*a*, 34*b* on the contact cover 9 (see FIG. 1) of the switching apparatus for the starter 1. As shown in FIG. 8, one switch terminal 34*a* is connected to the second magnet coil 62 through the control circuit 28, and the other switch terminal 34*b* is connected to the first magnet coil 59.

The relay coil 17 of the electromagnetic relay 5 and the second magnet coil 62 are both connected to the switch terminal 34*a*. In other words, the second magnet coil 62 and the relay coil 17 are interconnected to share the single switch terminal 34*a*. The control circuit 28 is arranged between the second magnet coil 62 and a connection point A where the relay coil 17 is connected to the switch terminal 34*a*.

The switch terminals 34*a*, 34*b* are connected to the electrical wirings 53*a*, 53*b* for applying an excitation current from the battery 3, respectively. A first starter relay 54*a* and a second starter relay 54*b* are inserted along the electrical wiring 53*a*, 53*b*, respectively.

Similar to the second embodiment, switching operation of the first and second starter relays 54*a*, 54*b* is controlled by the ECU 55 (see FIG. 8). Also, similar to the third embodiment, there is provided a delay time between timing for energizing the relay coil 17 and timing for energizing the second magnet coil 36. In other words, the control circuit 28 is operative to energize the second magnet coil 36 a predetermined delay time after having energized the relay coil 17.

There will now be explained operations of the switching apparatus for the starter 1 in accordance with the fifth embodiment of the present invention.

Once the ECU 55 is activated on reception of an on-signal from the IG-switch 56, the first and second starter relays 54*a*, 54*b* are simultaneously turned on by the drive signal outputted from the ECU 55. After that, through the operation of the pinion-pushing solenoid 57 including the first magnet coil 59, the pinion moves to the anti-motor direction to be engaged with the ring gear, and then the relay coil 17 of the electromagnetic relay 5 is magnetized for the relay contact to be turned on.

On the other hand, the second magnet coil 62 of the motor-energizing solenoid 58 is energized a predetermined time period after the energization of the relay coil 17 through the delaying function of the control circuit 28. Accordingly, the main contact will be kept in the off-state for the predetermined time period after the relay contact has been turned on.

There will then be formed a higher-resistance energizing path from the battery 3 to the motor 2 through the resistor 4. The resistor 4 enables an electric current flowing through the motor 2 to be reduced. Accordingly, the motor 2 rotates at a slow rotation speed.

Once the delay time has elapsed set by the control circuit 28, the main contact is turned on through the energization of the second magnet coil 62. There will then be formed a lower-resistance energizing path that bypasses the resistor 4 from the battery 3 to the motor 2. Since the motor 2 is energized by the full voltage of the battery 3, the motor 2 rotates at a higher rotation speed. The rotational motion of the motor 2 is transmitted from the pinion to the ring gear for the engine to be cranked.

(Sixth Embodiment)

The switching apparatus for the starter 1 in accordance with the sixth embodiment includes, similar to the fifth embodiment, the electromagnetic relay 5 with the normally-open contact point structure and the tandem-type electromagnetic switch 6 that comprises the pinion-pushing solenoid 57 for pushing the pinion and the motor-energizing solenoid 58 for opening and closing the main contact. In addition, the relay contact and the main contact are arranged in parallel with each other between the B-terminal 11 and the M-terminal 12, and the resistor 4 is connected in series with the relay contact (see FIG. 9).

Unlike the fifth embodiment, however, there is not provided the dedicated control circuit 28 that controls the time period during which the electric current flows through the resistor 4. In the sixth embodiment, the external ECU 55 is responsible for the delaying function in place of the control circuit 28.

Figure 9:
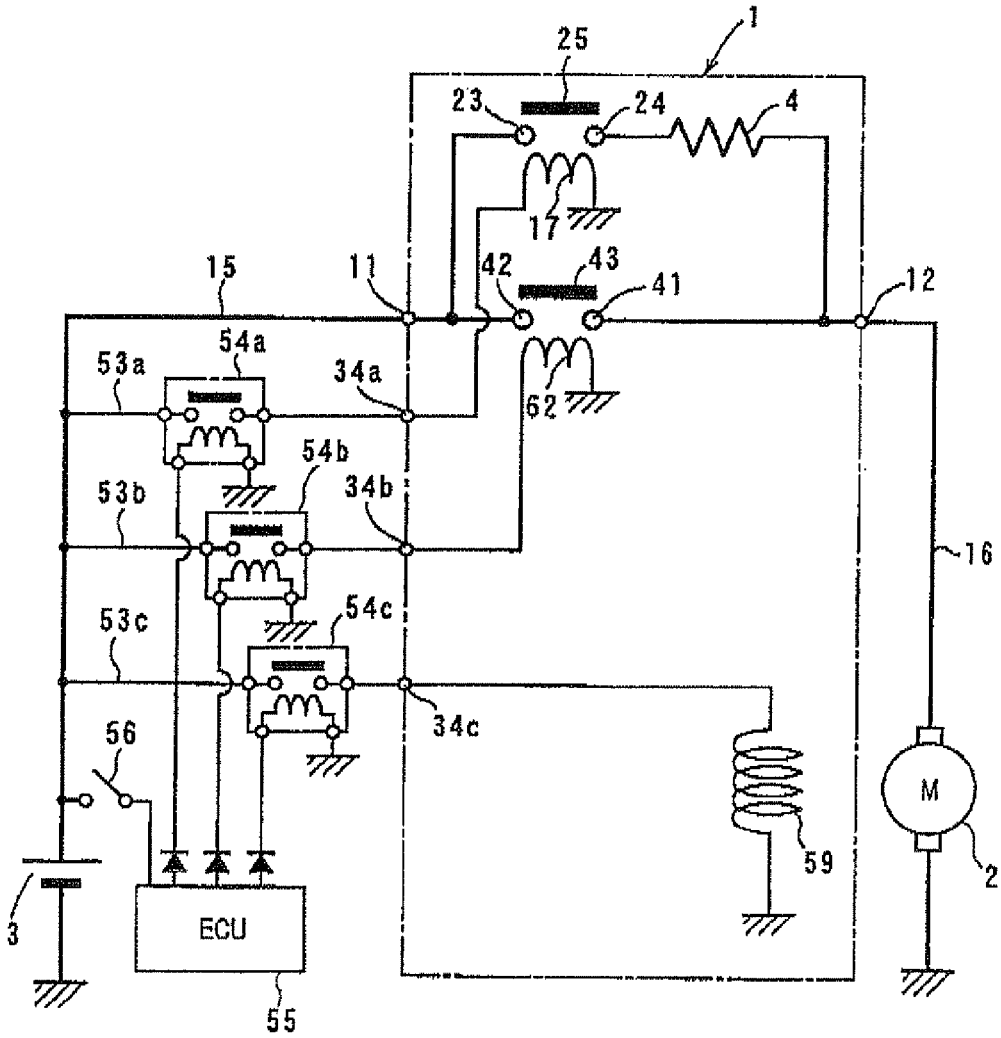
FIG. 9 is a circuit diagram of a switching apparatus for a starter in accordance with a sixth embodiment of the present invention.

As shown in FIG. 9, in the switching apparatus of the sixth embodiment, there are provided three switch terminals 34*a*, 34*b* and 34*c*. A first switch terminal 34*a* is connected to the relay coil 17, a second switch terminal 34*b* is connected to the second magnet coil 62, and a third switch terminal 34*a* is connected to the first magnet coil 59.

The first, second and third switch terminals 34*a*,34*b* and 34*c* are also connected to the electrical wirings 53*a*,53*b* and 53*c* for applying an excitation current to the relay coil 17 through the ECU 55, respectively. First, second and third starter relays 54*a*, 54*b* and 54*c* are inserted along the electrical wirings 53*a*, 53*b* and 53*c*, respectively. The switching operation of each starter relay 54*a*, 54*b* and 54*c* is controlled by the ECU 55.

There will now be explained operations of the switching apparatus for the starter 1 in accordance with the sixth embodiment of the present invention.

Once the ECU 55 is activated on reception of an on-signal from the IG-switch 56, the first and third starter relays 54*a* and 54*c* are simultaneously turned on by the drive signal outputted from the ECU 55. As a result, through the operation of the pinion-pushing solenoid 57 including the first magnet coil 59, the pinion moves to the anti-motor direction to be engaged with the ring gear, and at the same time the relay coil 17 of the electromagnetic relay 5 is magnetized for the relay contact to be turned on.

On the other hand, since the starter relay 54*b* is not turned on, the second magnet coil 62 of the motor-energizing solenoid 58 will not be energized. Therefore, the main contact will be kept in the off-state.

There will then be formed a higher-resistance energizing path from the battery 3 to the motor 2 through the resistor 4. The resistor 4 enables an electric current flowing through the motor 2 to be reduced. Accordingly, the motor 2 rotates at a slow rotation speed.

Then, once the second starter relay 54*b* is turned on by the drive signal outputted from the ECU 55, the second magnet coil 62 is excited, and then the main contact is turned on. There will then be formed a lower-resistance energizing path that bypasses the resistor 4 from the battery 3 to the motor 2. Since the motor 2 is energized by the full voltage of the battery 3, the motor 2 rotates at a higher rotation speed. The rotational motion of the motor 2 is transmitted from the pinion to the ring gear for the engine to be cranked.

The switching apparatuses for the starter 1 in accordance with the third-sixth embodiments, are based on circuit diagrams of FIG. 6-9, respectively. The structure of the switching apparatus for the starter 1 of the second embodiment is same as that of the switching apparatus for the starter 1 of the first embodiment. That is, the switching apparatus for the starter 1 comprises the housing formed of the bottomed frame 8 and the contact cover 9. In addition, the electromagnetic relay 5, the resistor 4 and the electromagnetic switch 6 (and the control circuit 28 in presence of it) are integrally accommodated inside the housing, and are connected to the motor circuit via the two external terminals (i.e., the B-terminal 11 and the M-terminal 12).

What is claimed is:

1. A switching apparatus for a starter, the apparatus comprising:

pinion-pushing means for pushing a pinion of the starter toward a ring gear of an engine;

main-contact-switching means for opening and closing a main contact for a motor circuit for supplying electrical power from a battery to a motor;

a resistor for suppressing a startup current that flows from the battery to the motor when the motor is started, the resistor being connected to the motor circuit; and energizing-path-switching means for switching between a higher-resistance energizing path from the battery to the motor is through the resistor and a lower-resistance energizing path that bypasses the resistor to energize the motor, wherein the pinion-pushing means, the main-contact-switching means, the resistor, and the energizing-path-switching means share a single housing, and are integrally accommodated inside the housing.

2. The apparatus of claim 1, wherein the resistor is connected to the motor circuit in series with the main contact, the energizing-path-switching means comprises a relay contact provided on the motor circuit that bypasses the resistor, a relay coil that forms an electromagnet through energization, and a movable core that is movable in an axial direction of the relay coil depending on an excitation state of the relay coil, and takes a form of an electromagnetic relay that opens and closes the relay contact in conjunction with movement of the movable core, the pinion-pushing means and the main-contact-switching means share a magnet coil that forms an electromagnet through energization, and a plunger that is movable in an axial direction of the magnet coil depending on an excitation state of the magnet coil, and take a form of an electromagnetic switch that compatibly implements the pinion-pushing means and the main-contact-switching means in conjunction with movement of the plunger.

3. The apparatus of claim 2, wherein the relay contact for the electromagnetic relay comprises a movable contact that is movable in the axial direction in conjunction with movement of the movable core, and a pair of fixed contacts confronted with the movable contact, one fixed contact among the pair of fixed contacts is connected to the motor circuit via an external connection terminal, a connection part connected to the external connection terminal and a contact part confronted with the movable contact are arranged at different positions in the axial direction, and at least a portion of the connection part is lapped over a portion of the contact part in a radial direction.

4. The apparatus of claim 3, wherein the external connection terminal to witch the fixed contact is connected is bolt-shaped, and a central axis of the external connection terminal and the central axis of the relay coil are arranged on the same axis.

5. The apparatus of claim 2, wherein the electromagnetic relay has a normally-closed contact point structure such that the relay contact is opened while the relay coil is excited, and the relay contact is closed while the relay coil is not excited.

6. The apparatus of claim 2, wherein a central axis of the relay coil for the electromagnetic relay and a central axis of the magnet coil for electromagnetic switch are arranged in parallel with each other.

7. The apparatus of claim 6, wherein the electromagnetic relay and the electromagnetic switch use a shared component for a part of their magnetic circuit.

8. The apparatus of claim 2, wherein the relay contact and the main contact comprise respective pairs of fixed contacts which are connected and disconnected by the respective movable contacts, one fixed contact among the pair of fixed contacts used for the relay contact is connected to a positive or negative potential side of the motor circuit relative to the main contact via the first external connection terminal, one fixed contact among the pair of fixed contacts used for the main contact is connected to a negative or positive potential side of the motor circuit relative to the relay contact via the second external connection terminal, the other fixed contact among the pair of fixed contacts used for the relay contact and the other fixed contact among the pair of fixed contacts used for the main contact are integrally or individually provided, and electrically and mechanically connected.

9. The apparatus of claim 1, wherein the resistor is connected to the motor circuit in series with the main contact, the energizing-path-switching means comprises a relay contact provided on the motor circuit that bypasses the resistor, a relay coil that forms an electromagnet through energization, and a movable core that is movable in an axial direction of the relay coil depending on an excitation state of the relay coil, and takes a form of an electromagnetic relay that opens and closes the relay contact in conjunction with movement of the movable core, the pinion-pushing means comprises a first magnet coil that forms an electromagnet through energization, and a first plunger that is movable in an axial direction of the first magnet coil depending on an excitation state of the first magnet coil, and takes a form of a pinion-pushing solenoid that pushes the pinion in conjunction with movement of the first plunger, the main-contact switching means comprises a second magnet coil that forms an electromagnet through energization, and a second plunger that is movable in an axial direction of the second magnet coil depending on an excitation state of the second magnet coil, and takes a form of a motor-energizing solenoid that opens and closes the main contact in conjunction with movement of the second plunger.

10. The apparatus of claim 9, wherein the relay contact for the electromagnetic relay comprises a movable contact that is movable in the axial direction in conjunction with movement of the movable core, and a pair of fixed contacts confronted with the movable contact, one fixed contact among the pair of fixed contacts is connected to the motor circuit via an external connection terminal, a connection part connected to the external connection terminal and a contact part confronted with the movable contact are arranged at different positions in the axial direction, and at least a portion of the connection part is lapped over a portion of the contact part in a radial direction.

11. The apparatus of claim 9, wherein the electromagnetic relay has a normally-closed contact point structure such that the relay contact is opened while the relay coil is excited, and the relay contact is closed while the relay coil is not excited.

12. The apparatus of claim 9, wherein a central axis of the first magnet coil for the pinion-pushing solenoid and a central axis of the second magnet coil for the motor-energizing solenoid are arranged on the same axis.

13. The apparatus of claim 12, wherein the pinion-pushing solenoid and the motor-energizing solenoid share a fixed core disposed between the first plunger and the second plunger.

14. The apparatus of claim 13, wherein the central axis of the relay coil for the electromagnetic relay and the central axis of the first magnet coil for the pinion-pushing solenoid and the second magnet coil for the motor-energizing solenoid are arranged in parallel with each other.

15. The apparatus of claim 14, wherein the electromagnetic relay and the motor-energizing solenoid use a shared component for a part of their magnetic circuit.

16. The apparatus of claim 9, wherein the relay contact and the main contact comprise respective pairs of fixed contacts which are connected and disconnected by the respective movable contacts, one fixed contact among the pair of fixed contacts used for the relay contact is connected to a positive or negative potential side of the motor circuit relative to the main contact via the first external connection terminal, one fixed contact among the pair of fixed contacts used for the main contact is connected to a negative or positive potential side of the motor circuit relative to the relay contact via the second external connection terminal, the other fixed contact among the pair of fixed contacts used for the relay contact and the other fixed contact among the pair of fixed contacts used for the main contact are integrally or individually provided, and electrically and mechanically connected.

17. The apparatus of claim 1, wherein the resistor is connected to the motor circuit in parallel with the main contact, the energizing-path-switching means comprises a relay contact that is connected to the motor circuit in series with the resistor and in parallel with the main contact, a relay coil that forms an electromagnet through energization, and a movable core that is movable in an axial direction of the relay coil depending on an excitation state of the relay coil, and takes a form of an electromagnetic relay that opens and closes the relay contact in conjunction with movement of the movable core, the pinion-pushing means and the main-contact-switching means share a magnet coil that forms an electromagnet through energization, and a plunger that is movable in an axial direction of the magnet coil depending on an excitation state of the magnet coil, and take a form of an electromagnetic switch that compatibly implements the pinion-pushing means and the main-contact-switching means in conjunction with movement of the plunger.

18. The apparatus of claim 1, wherein the resistor is connected to the motor circuit in parallel with the main contact, the energizing-path-switching means comprises a relay contact that is connected to the motor circuit in series with the resistor and in parallel with the main contact, a relay coil that forms an electromagnet through energization, and a movable core that is movable in an axial direction of the relay coil depending on an excitation state of the relay coil, and takes a form of an electromagnetic relay that opens and closes the relay contact in conjunction with movement of the movable core, the pinion-pushing means comprises a first magnet coil that forms an electromagnet through energization, and a first plunger that is movable in an axial direction of the first magnet coil depending on an excitation state of the first magnet coil, and takes a form of a pinion-pushing solenoid that pushes the pinion in conjunction with movement of the first plunger, the main-contact switching means comprises a second magnet coil that forms an electromagnet through energization, and a second plunger that is movable in an axial direction of the second magnet coil depending on an excitation state of the second magnet coil, and takes a form of a motor-energizing solenoid that opens and closes the main contact in conjunction with movement of the second plunger.

19. The apparatus of claim 1, further comprising a control circuit that controls a time period during which the motor is energized via the resistor when the motor is started, the control circuit being accommodated inside the housing.

20. The apparatus of claim 1, wherein the housing comprises a magnetic metal frame, and a contact cover that covers an opening of the frame to be assembled with the frame, and the frame forms a magnetic yoke as a part of the magnetic circuit.

* * * * *